US009986813B2

(12) United States Patent
Nakamura

(10) Patent No.: US 9,986,813 B2
(45) Date of Patent: Jun. 5, 2018

(54) WEARABLE ASSEMBLY WITH INTERCHANGEABLE DECORATIVE ITEMS

(71) Applicant: Maria Nakamura, Plantation, FL (US)

(72) Inventor: Maria Nakamura, Plantation, FL (US)

( * ) Notice: Subject to any disclaimer, the term of this patent is extended or adjusted under 35 U.S.C. 154(b) by 0 days. days.

(21) Appl. No.: 15/471,165

(22) Filed: Mar. 28, 2017

(65) Prior Publication Data

US 2017/0196344 A1 Jul. 13, 2017

Related U.S. Application Data

(63) Continuation-in-part of application No. 14/251,801, filed on Apr. 14, 2014, now Pat. No. 9,603,439.

(51) Int. Cl.

| | |
|---|---|
| ***A45F 3/04*** | (2006.01) |
| ***A43B 23/24*** | (2006.01) |
| ***A63F 9/10*** | (2006.01) |
| *A45F 3/00* | (2006.01) |

(52) U.S. Cl.

CPC ..... *A45F 3/04* (2013.01); *A43B 23/24* (2013.01); *A63F 9/10* (2013.01); *A45F 2003/001* (2013.01); *A63F 2009/1016* (2013.01)

(58) Field of Classification Search

CPC ..... A45F 3/04; A44C 25/00; A43B 23/24

USPC ..... 224/650, 644, 640

See application file for complete search history.

(56) References Cited

U.S. PATENT DOCUMENTS

| | | | | | |
|---|---|---|---|---|---|
| 2,302,560 | A * | 11/1942 | Santo | A45C 13/08 | 150/104 |
| 3,484,974 | A * | 12/1969 | Culmone | A41D 27/08 | 2/115 |
| 3,596,291 | A * | 8/1971 | Thill | A43B 3/0078 | 2/245 |
| 4,830,245 | A * | 5/1989 | Arakaki | A45F 3/04 | 2/2.5 |
| 5,222,642 | A * | 6/1993 | Solarz | A45C 13/08 | 224/191 |
| 5,255,834 | A * | 10/1993 | Bendersky | A45C 13/08 | 206/457 |
| 5,573,155 | A * | 11/1996 | Sadler | A45F 3/04 | 224/153 |
| 5,794,267 | A * | 8/1998 | Wallace | A41D 27/08 | 2/115 |
| 6,161,738 | A * | 12/2000 | Norris | A45C 9/00 | 109/49.5 |
| D483,940 | S * | 12/2003 | Dolan | D3/216 | |
| 6,769,585 | B2 * | 8/2004 | Santaniello | A45C 13/08 | 190/109 |
| 7,021,509 | B2 * | 4/2006 | Chuang | A45F 3/04 | 224/628 |
| D673,362 | S * | 1/2013 | Presman | D3/216 | |
| 9,474,355 | B1 * | 10/2016 | Chadwick | A45F 3/042 | |
| 2002/0157294 | A1 * | 10/2002 | Stanley | A01K 11/005 | 40/586 |

(Continued)

*Primary Examiner* — Brian D Nash

(74) *Attorney, Agent, or Firm* — The Concept Law Group; Scott M. Garrett; Scott D. Smiley

(57) ABSTRACT

A wearable assembly is disclosed including a decorative ornament having a coupling surface substantially opposite a decorative surface thereof; and a coupling member coupled to the coupling surface. The coupling member is adapted to selectively, removably couple to a wearable item such that the decorative surface is visible in an assembled configuration of the wearable assembly.

15 Claims, 7 Drawing Sheets

(56) References Cited

U.S. PATENT DOCUMENTS

| | | | | |
|---|---|---|---|---|
| 2003/0226242 | A1* | 12/2003 | Mitchell | A45D 8/185<br>24/3.2 |
| 2007/0228091 | A1* | 10/2007 | Shawen | A45C 15/00<br>224/153 |
| 2008/0277433 | A1* | 11/2008 | Karl | A45F 3/04<br>224/148.6 |
| 2015/0289629 | A1* | 10/2015 | Nakamura | A45F 3/04<br>36/136 |

* cited by examiner

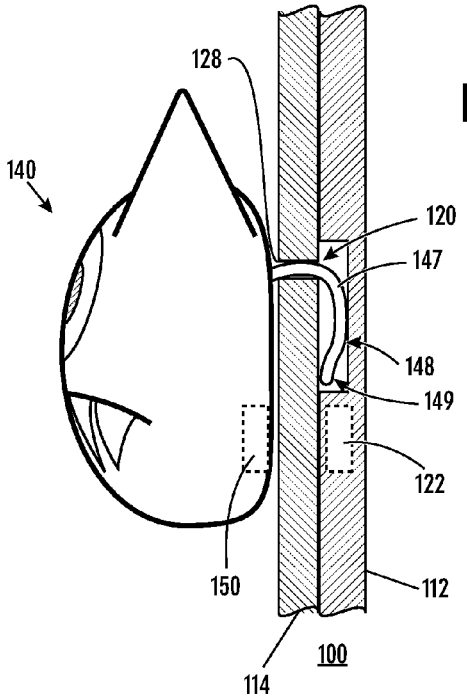
FIG. 3
FIG. 4A
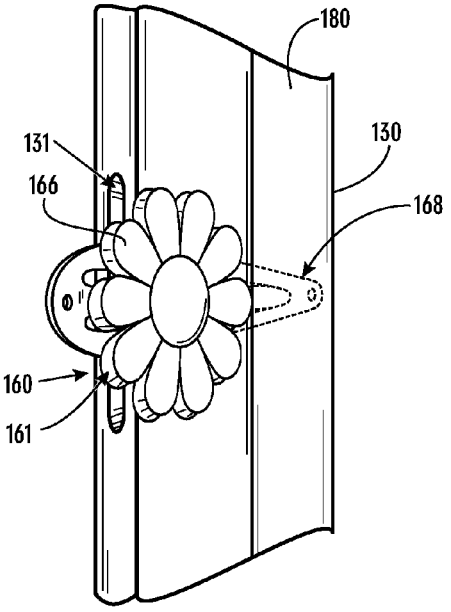
FIG. 4B
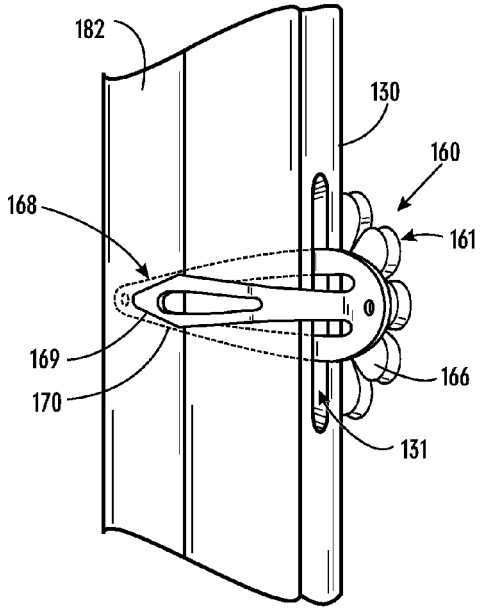

WEARABLE ASSEMBLY WITH INTERCHANGEABLE DECORATIVE ITEMS

CROSS-REFERENCE TO RELATED APPLICATION

This application claims priority to U.S. Non-Provisional patent application Ser. No. 14/251,801 filed Apr. 14, 2014, the entirety of which is incorporated by reference.

FIELD OF THE INVENTION

The present invention relates generally to a wearable assembly with removable and interchangeable decorative items, and more particularly relates to a wearable assembly including a wearable item having attachment features and at least one decorative item with a mating attachment feature for selective attachment to the wearable item in order to alter the appearance of the wearable item.

BACKGROUND OF THE INVENTION

Many consumers desire the ability to change the appearance of their wearable items, such as clothing, accessories, bags, footwear, and the like. However, many ornaments and embellishments that are provided on functional wearable items are permanent. For example, a backpack with a child's favorite cartoon character is typically integrated into the backpack as a permanent, integral decorative feature. An attempt to change the decorative feature would most likely damage, or permanently alter the backpack. This does not allow the child to selectively alter the appearance of the backpack in an interchangeable manner in order to satisfy the desire for variety.

One solution is to purchase a multitude of the same type of wearable item, such as a multitude of bags, with each bag having a different appearance. Thus, the consumer is able to switch out bags on different days in order to satisfy the desire for variety and match the bag to the particular outfit worn on any particular day. Unfortunately, this can be very costly as it requires purchasing many bags. Also, this requires the additional steps of having to remove all of the items in the bag and then transfer them to the other bag, which can be time consuming and inconvenient.

Some users desire the ability to incorporate an element of entertainment and amusement in a functional wearable item. In particular, many children and teenagers desire the ability to combine their functional wearable items with decorative and/or entertaining ornaments and embellishments. However, many functional wearable items do not provide a method of entertainment therein.

Therefore, a need exists to overcome the problems with the prior art as discussed above.

SUMMARY OF THE INVENTION

The invention provides a wearable assembly with interchangeable decorative items that overcomes the hereinaforementioned disadvantages of the heretofore-known devices and methods of this general type and that allows users to selectively remove and interchange a plurality of decorative items on a wearable item.

With the foregoing and other objects in view, there is provided, in accordance with the invention, a wearable assembly having a wearable item including a coupling member; and a decorative ornament including a coupling surface substantially opposite a decorative surface thereof;

and a mating coupling member coupled to the coupling surface, the mating coupling member adapted to selectively, removably couple to the coupling member of the wearable item such that the decorative surface is visible in an assembled configuration of the wearable assembly.

In accordance with another feature, the wearable item is a backpack, the backpack comprising a backpack main body including a front panel opposite a rear panel and defining a storage compartment.

In accordance with a further feature of the present invention, the coupling member is a magnet attached to the front panel and the mating coupling member is a mating magnet sized and configured to magnetically couple to the magnet on front panel of the backpack main body.

In accordance with a further feature of the present invention, the mating coupling member is formed as a hook and the backpack main body further includes a slit through a front surface of the front panel, the slit defining an opening sized and configured to receive the hook for hanging the decorative ornament on the front panel.

In accordance with another feature of the present invention, the backpack further includes a shoulder strap having a shoulder strap front panel and a shoulder strap rear panel, the shoulder strap front and rear panels defining an opening therethrough; and the mating coupling member is formed as a clip having a pair of fingers adapted to fasten onto the shoulder strap by sliding the clip into the opening such that each finger frictionally grips the shoulder strap rear panel.

In accordance with yet another feature of the present invention, the decorative surface and the coupling surface forms a pocket for receiving and storing small items in the decorative ornament.

In accordance with a further feature, the decorative ornament is formed as a puzzle assembly including a plurality of puzzle pieces, each of the plurality of puzzle pieces shaped so that when the puzzle pieces are assembled together edge-to-edge in an assembled configuration, a decorative feature on the decorative surface is formed.

In accordance with another feature, at least one of the plurality of puzzle pieces includes an arm extending from a side of the puzzle piece, the arm sized and shaped to matingly engage arm-receiving apertures defined by an adjacent one of the plurality of puzzle pieces in the assembled configuration.

In accordance with a further feature of the present invention, the backpack main body further includes a plurality of magnets attached to the front panel and a plurality of mating magnets is coupled to a rear surface of each of the plurality of puzzle pieces, each of the plurality of mating magnets sized and configured to magnetically couple to a respective magnet on front panel of the backpack main body.

In accordance with yet another feature of the present invention, the wearable item is a backpack, the backpack including a flap and a backpack main body, the backpack main body including a front panel opposite a rear panel and defining a storage compartment, and the flap coupled to and extending around a peripheral edge of the front panel such that when the flap is folded downward toward the front panel, the flap engages and couples to the decorative ornament.

In accordance with another feature, the decorative ornament is formed as a decorative panel comprising material that is configured to receive and display markings from at least one of: ink, crayon, and paint.

In accordance with yet another feature, the backpack main body further includes a plurality of fasteners attached to an interior flap surface, opposite the exterior flap surface; and the decorative panel includes a plurality of mating fasteners positioned such that when the decorative panel is placed on top of the front panel and the flap is folded downward toward the front panel, the plurality of fasteners on the interior flap surface fastens to the plurality of mating fasteners on the decorative panel for securing the decorative panel to the backpack main body.

In accordance with a further feature, the wearable item is a shoe and the mating coupling member is formed as a clip having a pair of fingers adapted to fasten onto a peripheral top edge of an opening of the shoe by sliding the clip onto the top edge such that each finger frictionally grips opposing sides of the top edge.

In accordance with another feature of the present invention, the shoe includes a slit through a surface of the shoe, the slit defining an opening sized and configured to receive the mating coupling member of the decorative ornament therethrough.

In accordance with another feature, an embodiment of the present invention includes a backpack assembly having a backpack main body including a front panel opposite a rear panel and defining a storage compartment; and a decorative ornament having a main body, a decorative feature, and a coupling member for coupling the decorative ornament to the front panel in an assembled configuration.

In accordance with another feature, an exterior front panel defining an outer visible surface of the backpack assembly when the exterior front panel is placed on a top surface of the front panel in an assembled configuration; and wherein the coupling member is formed as a hook and the exterior front panel includes a slit through a front surface thereof, the slit defining an opening sized and configured to receive the hook for hanging the decorative ornament on the front panel.

In accordance with the present invention, a method for selectively, interchangeably decorating a backpack assembly includes providing a backpack assembly having a backpack main body having a front panel opposite a rear panel and defining a storage compartment; and a plurality of decorative ornaments, each of the plurality of decorative ornaments having a main body, a decorative feature, and a coupling member for coupling the decorative ornament to the front panel in an assembled configuration, where at least one of the plurality of decorative ornaments is different in appearance from a second one of the plurality of decorative ornaments. The method further includes coupling the at least one of the plurality of decorative ornaments to the front panel; after coupling the at least one of the plurality of decorative ornaments, removing the at least one of the plurality of decorative ornaments from the front panel; and after removing the at least one of the plurality of decorative ornaments, coupling the second one of the plurality of decorative ornaments to selectively alter the visual appearance of the backpack main body.

In accordance with another feature, an embodiment of the present invention includes a backpack assembly including a backpack main body with a front panel opposite a rear panel and defining a storage compartment; and at least one fastener on at least a portion of the backpack main body; and a first decorative panel having a shape corresponding to a shape of the front panel of the backpack main body; and having at least one mating fastener operably configured to mate with the at least one fastener on the backpack main body for selectively, removably coupling the first decorative panel to the backpack main body so as to cover at least a portion of the front panel of the backpack main body.

In accordance with another feature of the present invention, the at least one fastener on the backpack main body is disposed on a flap coupled to and extending around a peripheral edge of the front panel of the backpack main body such that when the flap is folded downward toward the front panel, the at least one fastener is selectively couplable to the at least one mating fastener on the first decorative panel.

In accordance with yet another feature of the present invention, the first decorative panel is made of a material that is configured to receive and display markings from at least one of: ink, crayon, and paint.

In accordance with yet another feature of the present invention, the first decorative panel includes a three-dimensional decorative ornament.

In accordance with another feature of the present invention, the at least one fastener on the at least the portion of the backpack main body includes a plurality of magnets attached to the front panel; and the at least one mating fastener on the first decorative panel includes a plurality of mating magnets coupled to a rear surface of the first decorative panel, each of the plurality of mating magnets sized and configured such that the first decorative panel covers the at least the portion of the front panel of the backpack main body when the plurality of magnets on the backpack main body are magnetically coupled to the plurality of mating magnets on the first decorative panel.

In accordance with yet another feature of the present invention, the first decorative panel is segmented into a plurality of puzzle pieces that form a unified decorative feature when the plurality of puzzle pieces are assembled together edge-to-edge in an assembled configuration and the plurality of magnets on the backpack main body are magnetically coupled to the plurality of mating magnets on the first decorative panel.

In accordance with yet another feature of the present invention, the first decorative panel is sized to substantially cover the front panel of the backpack main body when the at least one mating fastener on the first decorative panel is coupled to the at least one fastener on the backpack main body.

In accordance with yet another feature of the present invention, the first decorative panel is sized to entirely cover the front panel of the backpack main body when the at least one mating fastener on the first decorative panel is coupled to the at least one fastener on the backpack main body.

In accordance with yet another feature, an embodiment of the present invention further includes a second decorative panel having a decorative feature different than a decorative feature on the first decorative panel.

In accordance with yet another feature of the present invention, the first decorative panel is segmented into a plurality of puzzle pieces that form a unified decorative feature when the plurality of puzzle pieces are assembled together edge-to-edge in an assembled configuration; and each of the plurality of puzzle pieces includes at least one arm extending from a side of the puzzle piece, the at least one arm sized and shaped to matingly engage arm-receiving apertures defined by an adjacent one of the plurality of puzzle pieces in the assembled configuration.

In accordance with yet another feature of the present invention, the at least one fastener on the backpack main body is disposed on an interior surface of a flap coupled to and extending around a peripheral edge of the front panel of the backpack main body; and the at least one mating fastener on the first decorative panel is disposed such that when the first decorative panel is placed on top of the front panel and the flap is folded downward toward the front panel, the at least one fastener on the interior surface of the flap fastens to the at least one mating fastener on the first decorative panel for securing the first decorative panel to the backpack main body.

In accordance with yet another feature, an embodiment of the present invention includes a method of providing decorative variety to a backpack including a backpack assembly with a backpack main body with a front panel, a main backpack storage compartment, and at least one fastener on at least a portion of the backpack main body; a first decorative panel having a shape corresponding to a shape of the front panel of the backpack main body; and at least one mating fastener operably configured to mate with the at least one fastener on the backpack main body for selectively, removably coupling the first decorative panel to the backpack main body so as to cover at least a portion of the front panel of the backpack main body; and a second decorative panel having a shape corresponding to a shape of the front panel of the backpack main body; and at least one mating fastener operably configured to mate with the at least one fastener on the backpack main body for selectively, removably coupling the second decorative panel to the backpack main body so as to cover at least a portion of the front panel of the backpack main body, the second decorative panel having a decorative feature that is different than a decorative feature on the first decorative panel; and coupling the first decorative panel to the backpack main body so as to cover the at least the portion of the front panel of the backpack main body and visually expose the decorative feature of the first decorative panel to an external environment. In accordance with another feature, an embodiment of the present invention further includes after coupling the first decorative panel, uncoupling the first decorative panel from the backpack main body; and after uncoupling the first decorative panel from the backpack main body, coupling the second decorative panel to the backpack main body so as to cover the at least the portion of the front panel of the backpack main body and visually expose the decorative feature of the second decorative panel to the external environment.

Although the invention is illustrated and described herein as embodied in a wearable assembly with interchangeable decorative items, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIG. 3 is an enlarged sectional view of the backpack assembly of FIG. 1, illustrating attachment of an ornament to panels of the backpack assembly via a hook and a magnet;

FIG. 4*a* is an enlarged perspective front view of a strap of the backpack assembly of FIG. 1, illustrating attachment of a second ornament to the strap of the backpack assembly via a clip;

FIG. 4*b* is an enlarged perspective rear view of the strap of the backpack assembly of FIG. 1, illustrating attachment of a second ornament to the strap of the backpack assembly via the clip;

DETAILED DESCRIPTION

Figure 1:
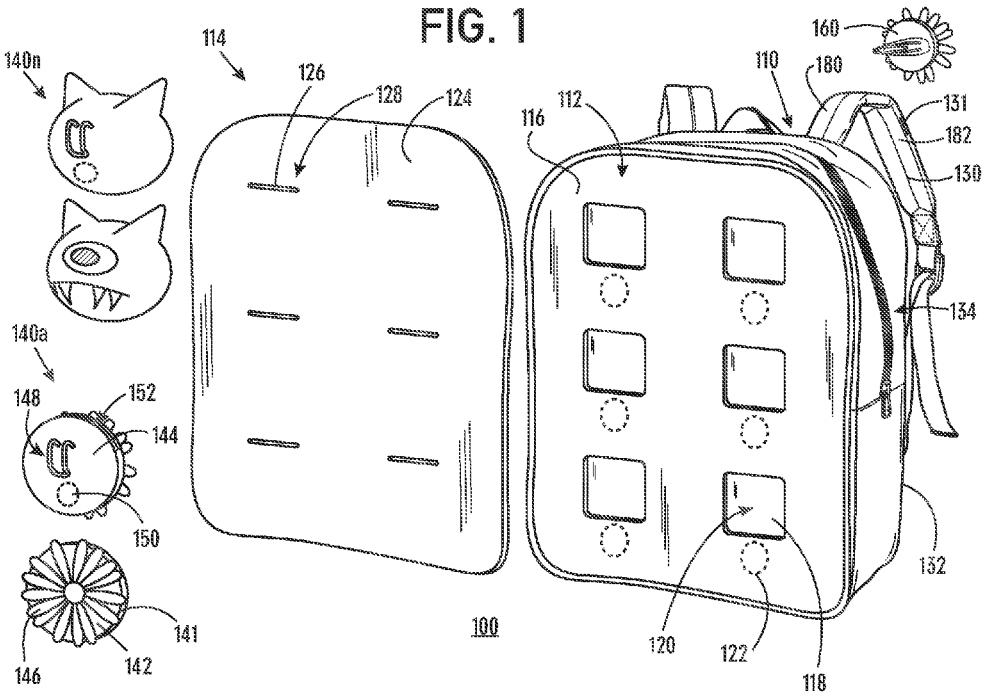
FIG. 1 is an exploded perspective view of a backpack assembly with interchangeable decorative ornaments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient wearable assembly that includes interchangeable decorative items that can be attached and removed from a main body of the wearable assembly. Embodiments of the invention provide a backpack assembly with decorative ornaments that can be attached to and removed from a front panel of the backpack. In addition, embodiments of the invention provide a decorative ornament that is configured to be selectively attached to other wearable items, such as footwear.

Referring now to FIG. 1, one embodiment of the present invention is shown in an exploded perspective view. FIG. 1 shows several advantageous features of the present invention, but, as will be described below, the invention can be provided in several shapes, sizes, combinations of features and components, and varying numbers and functions of the components. The first example of a wearable assembly in accordance with the present invention is a backpack assembly 100, as shown in FIG. 1, and includes a backpack main body 110, an exterior front panel 114, a main body decorative ornament 140, and a shoulder strap decorative ornament 160.

The backpack main body 110 is a wearable item that defines a main storage compartment 134 for storing items, such as books, laptops, note pads, and the like. The backpack main body 110 includes a front panel 112 opposite a rear panel 132 of the main body 110. The front panel 112 supports attachment of the main body decorative ornament 140. There can be a multitude of decorative ornaments 140*a-n* supported on the front panel 112, where the number of decorative ornaments 140 between "a" through "n" can be any number. The front panel 112 defines a cutout 118 having an opening 120 at a front surface 116 of the front panel 112, the cutout 118 being sized and configured to receive and house an attachment feature of the main body decorative ornament 140. A main body magnet 122 can be provided on the front panel proximate to the cutout 118. The main body magnet 122 can be sown, coupled, attached, adhered with an adhesive, or otherwise fastened onto, supported by, or integrated into the front panel 112. As illustrated in FIG. 1, the main body magnet 122 is coupled to the front panel 112 just below the corresponding cutout 118. The backpack main body 110 further includes a pair of shoulder straps 130 extending from a surface of the rear panel 132. In one embodiment, the shoulder strap 130 includes a front panel 180 and a rear panel 182, the shoulder strap 130 defining an opening 131 between the front panel 180 and the rear panel 182.

The exterior front panel 114 can be a separate panel, apart from the front panel 112 of the main body 110. The exterior front panel 114 provides an outer surface that is visible to individuals when the backpack assembly 110 is assembled. The exterior front panel 114 defines a slit 126 through a front surface 124 of the exterior front panel 114, the slit 126 defining an opening 128 sized and configured to receive an attachment feature of the main body decorative ornament 140.

The decorative ornament 140 includes a main body 141, a decorative feature 146, a coupling member 148, and a mating magnet 150. The main body 141 can be fabric, plastic or other polymer material, and the like. The main body 141 defines a pocket 152 for receiving and storing small items in the decorative ornament 140 that are retrievable without having to open the main storage compartment of the backpack assembly 100. The decorative feature 146 is a small ornament supported by and coupled to a front surface 142 of the main body 141, the front surface 142 being a decorative surface of the decorative ornament, which is substantially opposite a rear, coupling surface 144 of the decorative ornament 140. In other embodiments, the decorative feature 146 can be a plush toy, a ribbon, a bow, a jewel, a small charm, an image applied to the front surface 142 of the main body 141, a logo, a cartoon character, and the like. The coupling member 148 is operably configured to couple the decorative ornament 140 to the backpack main body 110. In one embodiment, the coupling member 148, as illustrated in FIG. 1, is a hook affixed to the rear surface 144 of the main body 141 of the decorative ornament 140, the rear surface 144 being a coupling surface of the decorative ornament 140 substantially opposite the decorative front surface 142. The coupling member 148 is sized and configured to pass through the opening 128 of the slit 126 and engage the cutout 118 of the backpack main body front panel 112. In other embodiments, the coupling member 148 can be a snap fastener, a hook or loop strip of a hook-and-loop attachment system, a clip, a clamp, a tie, and the like. The mating magnet 150 can be coupled to the rear surface 144 of the main body 141. The mating magnet 150 can be sown, coupled, attached, adhered with an adhesive, or otherwise fastened onto, supported by, or integrated into the main body 141. The mating magnet 150 is sized and configured to magnetically couple to the corresponding main body magnet 122 on the backpack main body 110. The mating magnet 150 and the main body magnet 122 are operably configured and positioned to attract toward each other with a magnetic force sufficient to support the decorative ornament 140 on the backpack main body 110. In one embodiment, the magnetic force provided by the magnets 150, 122 is sufficient to support the decorative ornament 140 on the backpack main body 110, without the additional assistance of the coupling member 148. Attachment solely via the magnets 150, 122 provides a quick and convenient method and apparatus for selectively removing and exchanging decorative ornaments 140.

Figure 2:
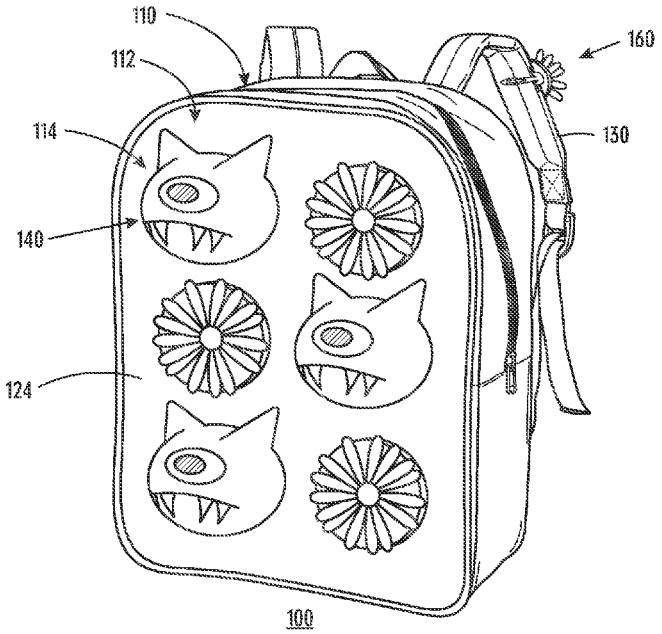
FIG. 2 is an assembled perspective view of the backpack assembly of FIG. 1.

As illustrated in FIGS. 1-2, the backpack assembly 100 can include a plurality of decorative ornaments 140, with respective cutouts 118, slits 126, and magnets 122 on the backpack main body 110 to selectively couple the plurality of ornaments 140 to the backpack main body 110. The plurality of decorative ornaments 140*a-n* preferably includes at least one decorative ornament 140*a* that is different in appearance from a second decorative ornaments 140*n* to, advantageously, provide the user with visual variety. Additionally, the user can interchange the decorative ornaments 140*a-n* such that, for example, the decorative ornament 140*a* is attached for one week and another decorative ornament 140*n* is attached during another week.

Referring now primarily to FIG. 2, the backpack assembly 100 is shown in an assembled configuration. More particularly, the decorative ornament 140 is shown on the front surface 124 and coupled to the backpack main body 110. In the assembled configuration, the exterior front panel 114 is on top of the main body front panel 112, such that the only the exterior front panel 114 is visible. The shoulder strap decorative ornament 160 is shown coupled with shoulder strap 130. As best illustrated with reference to FIGS. 1 and 3, each of the cutouts 118 is aligned with the respective slit 126, such that the coupling member 148 is able to pass through the respective slit opening 128 and rest, or hang, on the exterior front panel 114 with a curved portion 147 of the coupling member 148. The cutout opening 120 receives the coupling member 148.

Referring now primarily to FIG. 3, the backpack assembly 100 is shown in an enlarged sectional view, illustrating the decorative ornament 140 coupled to the main body front panel 112 and the exterior front panel 114. More particularly, the coupling member 148 passes through the slit opening 128 and the cutout opening 120, being housed in a cavity 149 formed by the main body front panel 112 and the exterior front panel 114 abutting one another.

Referring now primarily to FIGS. 4*a-b*, the shoulder strap 130 is shown in enlarged perspective views, illustrating the shoulder strap decorative ornament 160 coupled to the shoulder strap 130. The shoulder strap decorative ornament 160 includes a main body 161 having a decorative feature 166 and a coupling member 168 affixed to the decorative feature 166. The coupling member 168 is formed as a clip. The coupling member 168 is sized and configured to fasten to the shoulder strap 130. The coupling member 168 includes a pair of fingers 169, 170 adapted to fasten onto the shoulder strap 130. The opening 131 is operably configured to slidably receive the clip finger 170 therethrough, such that each finger 169, 170 frictionally grips opposing sides of the rear panel 182. Advantageously, only the decorative feature 166 of the shoulder strap decorative ornament 160 is visible when the backpack assembly 100 is worn by the user, because the fingers 169, 170 are positioned behind the front panel 180, with the finger 169 positioned directly behind the rear panel 182 and the finger 170 positioned directly behind the front panel 180 (but in front of the rear panel 182).

Figure 5:
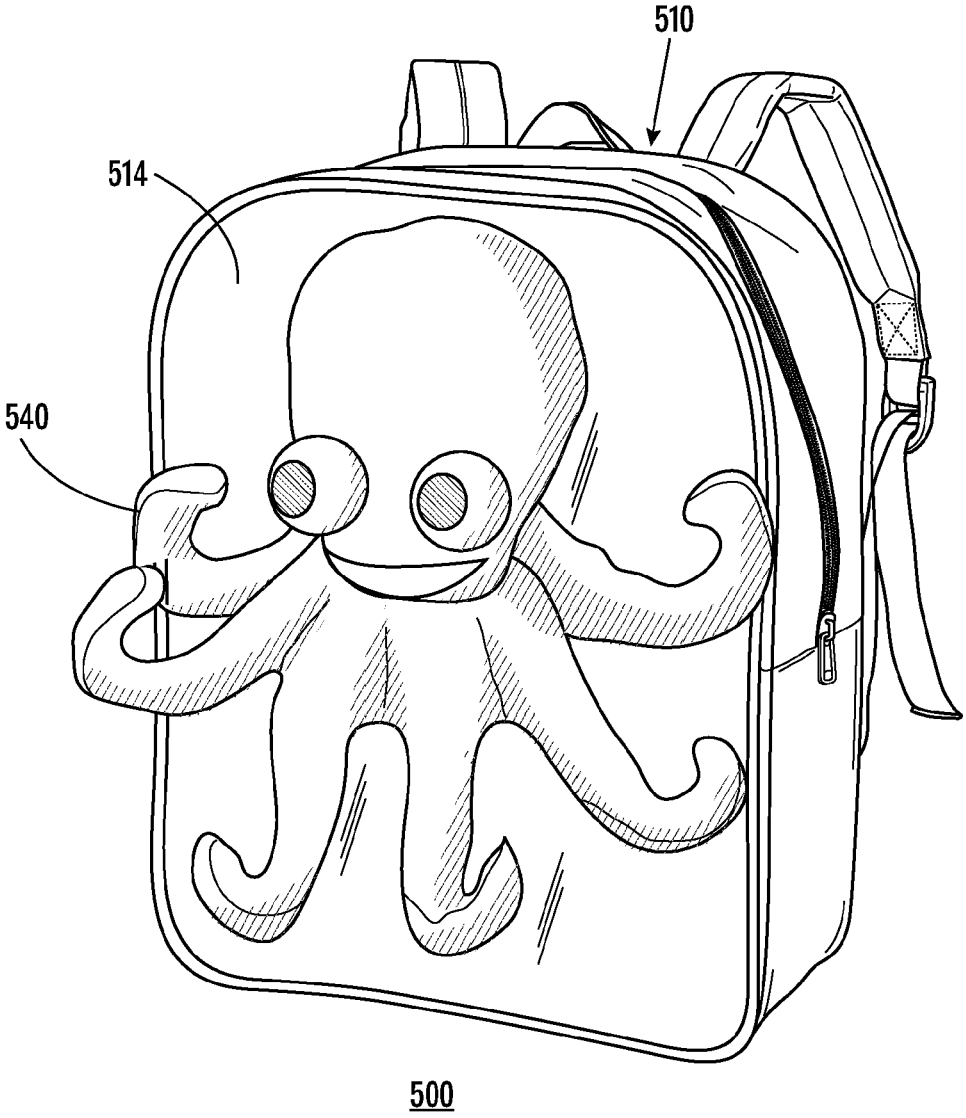
FIG. 5 is an assembled perspective view of a further exemplary embodiment of a backpack assembly in accordance with the present invention with an interchangeable plush toy.

Referring now primarily to FIG. 5, another exemplary embodiment of a wearable assembly in accordance with the present invention is illustrated in a perspective view as a backpack assembly 500. The backpack assembly 500 includes a main backpack body 510 similar to the main backpack body 110. The primary difference between the assembly 100 and the assembly 500 is that the assembly 500 includes a singular plush toy 540 as a decorative feature removably coupled to an exterior front panel 514 of the backpack main body 510. The plush toy 540 can be, for example, a stuffed animal, such as a teddy bear, and the like. The plush toy 540 can be coupled to the front panel 514 using the apparatuses and methods described above with reference to the backpack assembly 100.

Figure 6:
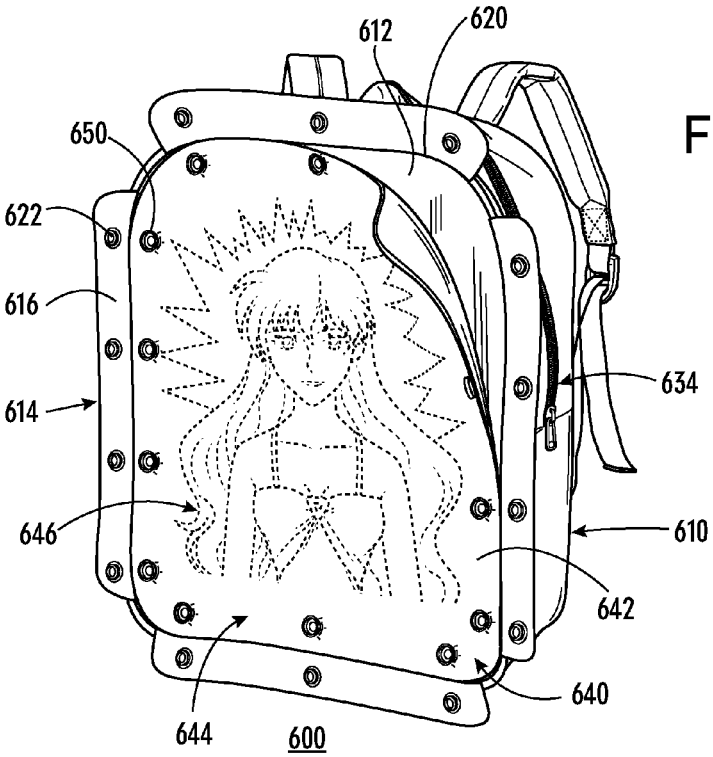
FIG. 6 is a perspective view of another exemplary embodiment of a backpack assembly in accordance with the present invention with an interchangeable decorative panel, before the decorative panel is secured via snap attachments.
Figure 7:
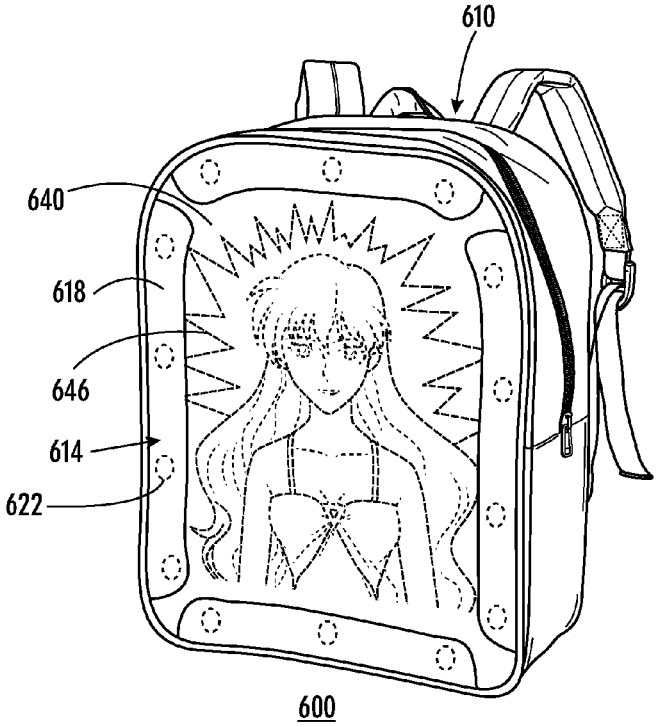
FIG. 7 is a perspective view of the backpack assembly of FIG. 6, after the decorative panel is secured via snap attachments.

Referring now primarily to FIGS. 6-7, another exemplary embodiment of a wearable assembly in accordance with the present invention is illustrated in a perspective view as a backpack assembly 600. The backpack assembly 600 includes a backpack main body 610, a flap 614, and a decorative panel 640. The backpack main body 610 defines a main storage compartment 634 for storing items, such as books, laptops, note pads, and the like. The backpack main body 610 includes a main body front panel 612 adapted to support attachment of and selectively receive the decorative panel 640.

The flap 614 is coupled to and extends around a peripheral edge 620 of the main body front panel 612. In one embodiment, the flap 614 can be a thin piece of fabric that is sown around the peripheral edge of the main body front panel 612. In the exemplary embodiment, the flap 614 is segmented into a plurality of flap panels, each of the plurality of flap panels coupled to a peripheral edge 620. In other embodiments, the flap 614 can be formed as a unitary panel that is coupled to the peripheral edge 620 in a continuous manner around the length of the peripheral edge 620. A plurality of fasteners 622 are attached to an interior flap surface 616, opposite an exterior flap surface 618. The fastener 622 is formed as a snap fastener. In other embodiments, the fastener 622 can be a hook or loop strip of a hook-and-loop attachment system, a clip, a clamp, a tie, and the like. The flap 614 is preferably sized and configured to support and couple to the selected fastener type. The plurality of fasteners 622 can be arranged along a length of the flap 614 in a linear manner and being equally spaced apart from one another. The plurality of fasteners 622 are positioned on the flap 614, such that when the decorative panel 640 is positioned on top of the main body front panel 612 and, subsequently, the flap 614 is folded downward, toward the main body front panel 612, the flap 614 engages and substantially covers an outer edge 644 of the decorative panel 640 and the plurality of fasteners 622 engages and fastens to a plurality of mating fasteners 650 positioned along the outer edge 644 of the decorative panel 640.

In one embodiment, the decorative panel 640 has a shape corresponding to a shape of the main body front panel 612 as can be seen in FIGS. 6-7 (as well as FIGS. 1-2). In other words, the decorative panel 640 may be sized and shaped so as to substantially cover the main body front panel 612 when coupled together. As used herein, the phrase "substantially cover" is intended to indicate at least 80% of a surface area covered. In a further embodiment, the decorative panel 640 may be sized and shaped to entirely cover the main body front panel 612 when coupled together. In yet another embodiment, the decorative panel 640 may be sized and shaped so as to cover at least 50% of a front surface of the main body front panel 612 when coupled together. Advantageously, such embodiments allow the front (visually exposed) surface of the backpack main body to be essentially interchanged with various decorative features so as to provide visual variety to the user.

The decorative panel 640 further includes a decorative feature 646. In some embodiments, the decorative feature 646 can be an image painted, sown, printed, or otherwise applied to a front surface 642 of the decorative panel 640. The decorative panel 640 can be shaped substantially circumscribing the shape of the main body front panel 612. For example, if the main body front panel 612 is square-shaped, the decorative panel 640 is formed as a square shape. The image can be a logo, a cartoon character, a sports team logo, an ornamental design, and the like. In other embodiments, the decorative feature 646 can be a plush toy, a ribbon, a bow, a jewel, a small charm, and the like. In one embodiment, the decorative feature 646 is formed as an outline of an image and the decorative panel 640 is comprised of a writeable material configured to receive and display markings from one of a group of ink, crayon, and paint. Accordingly, the user can color the image for display on the backpack assembly 600, and when the user desires visual variety and entertainment, the user can obtain a second decorative panel 640 having a different image to color and display.

The plurality of mating fasteners 650 on the decorative panel 640 are sized and configured to mate with the plurality of fasteners 622 attached along the interior flap surface 616. The plurality of mating fasteners 650 are coupled to the front surface 642 of the decorative panel 640 in a placement pattern matching the placement pattern of the plurality of fasteners 622 on the flap 614. The plurality of mating fasteners 650 can be sown into the decorative panel 640, attached to the panel 640 with an adhesive, integrated into the panel 640, and the like. In use, the user can fold the flap 614 downward such that the plurality of fasters 622 engages the plurality of mating fasteners 650 for fastening and securing the decorative panel 640 to the backpack main body 610, as illustrated in FIG. 7. In this assembled configuration, the fasteners 622, 650 are not visible, because the exterior flap surface 618 forms a frame around the decorative feature 646, while substantially covering the fasteners 622, 650.

In an alternative embodiment, the decorative panel 640 may be devoid of flaps and mating fasteners as described herein above, but may be selectively, removably couplable to the backpack main body 610 in other forms and configuration, such as, for example, with a zipper. For example, in one embodiment, a zipper half may extend continuously along an edge of the decorative panel 640 and a mating zipper half may extending continuously about a portion of the backpack main body 610 so as to permit the decorative panel 640 to be selectively removable from the backpack main body 610 (via zipping and unzipping the zipper halves), allowing users to change out various decorative panels 640 for visual variety. In yet other embodiments, the decorative panel 640 may be removably couplable to the backpack main body 610 with other types of fasteners.

Figure 8:
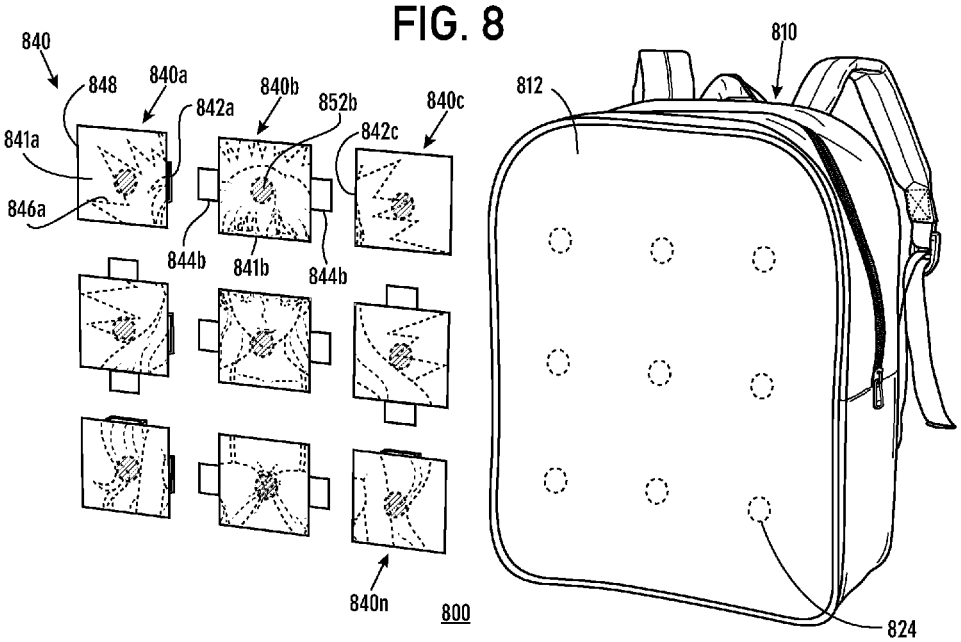
FIG. 8 is an exploded perspective view of yet another exemplary embodiment of a backpack assembly with an interchangeable decorative puzzle assembly in accordance with the present invention.
Figure 9:
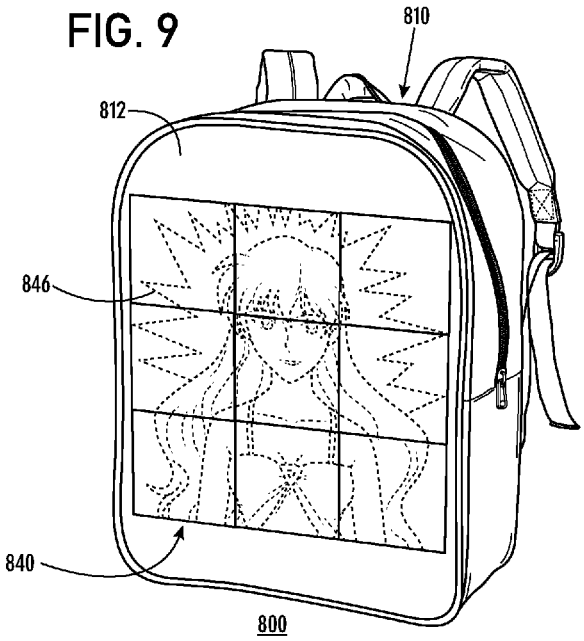
FIG. 9 is an assembled perspective view of the backpack assembly of FIG. 8.

Referring now primarily to FIGS. 8-9, another exemplary embodiment of a wearable assembly in accordance with the present invention is illustrated in a perspective view as a backpack assembly 800. The backpack assembly 800 includes a main backpack body 810 similar to the main backpack body 110. The primary difference between the assembly 100 and the assembly 800 is that the assembly 800 includes a puzzle assembly 840 as a decorative feature removably coupled to an exterior front panel 812 of the main backpack body 810. The puzzle assembly 840 includes a plurality of puzzle pieces 840*a-n*, where the number of puzzle pieces between "a" and "n" can be any number. Each puzzle piece 840 is shaped so that when the puzzle pieces 840*a-n* are assembled together edge-to-edge in one particular assembled configuration, a decorative feature 846, distributed across all of the puzzle pieces 840*a-n*, is formed. For example, the decorative feature 846 can be an image of a cartoon character that is distributed piece-wise across all of the puzzle pieces 840*a-n*. When the puzzle pieces 840*a-n* are assembled together in an intended assembled configuration (FIG. 9), the puzzle assembly 840 resembles the cartoon character. When the puzzle pieces 840*a-n* are assembled together in another configuration, other than the intended assembled configuration, the puzzle assembly 840 does not resemble the cartoon character. This provides users with both a decorative feature, as well as, a method of entertainment and education. The puzzle pieces 840*a-n* are rectangular shaped. In other embodiments, the puzzle pieces 840*a-n* can be other shapes, such as jigsaw shaped. Some of the puzzle pieces 840*a-n* can include a pair of arms 844 extending from opposing sides of a main body 841 of the puzzle piece 840. The arms 844 are sized and shaped to matingly engage arm-receiving apertures 842 defined by adjacent puzzle pieces 840 in the intended assembled configuration. For example, a portion of the decorative feature 846 is distributed across 840*a*, 840*b*, and 840*c*, such that when the puzzle piece 840*b* is between the puzzle piece 840*a* and the puzzle piece 840*c* in an edge-to-edge manner, a partial top section of the decorative feature 846 is formed in the intended assembled configuration. Accordingly, the puzzle piece 840*b* includes a pair of arms 844 configured to slidably insert within the respective arm-receiving apertures 842 of the puzzle pieces 840*a* and 840*b*. This provides frictional support to keep the puzzle assembly 840 in the intended assembled configuration.

The puzzle assembly 840 can be coupled to the exterior front panel 812 of the main backpack body 810 with magnets, similar to the magnets discussed above. Each of the plurality of puzzle pieces 840*a-n* can further include a magnet 852 coupled to a rear surface 848 of the main body 841 of the puzzle piece 840. A respective mating magnet 824 is coupled to the exterior front panel 812 of the main backpack body 810. Placement of the magnets 852, 824 on the puzzle pieces 840*a-n* and front panel 812, respectively, is configured such that when the plurality of puzzle pieces 840*a-n* are in an assembled configuration, the magnet 852 and the respective mating magnet 824 are magnetically coupled to secure the puzzle assembly 840 to the main backpack body 810. In other embodiments, the puzzle assembly 840 can be secured to the main backpack body 810 by hooks, as explained above with respect to FIGS. 1-3. Accordingly, instead of or in addition to magnets 852, hooks can be coupled to the rear surface 848 of the main body 841 of the puzzle piece 840. In yet another embodiment, the puzzle assembly 840 can be secured to the main backpack body 810 by clips, as explained above with respect to FIG. 4. In this embodiment, instead of or in addition to magnets 852, clips can be coupled to the rear surface 848 of the main body 841 of the puzzle piece 840. In further embodiments, the puzzle assembly 840 can be secured to the main backpack body 810 by snap fasteners, as explained above with respect to FIGS. 6-7. Accordingly, instead of or in addition to magnets 852, snap fasteners on a flap of the main backpack body and mating snap fasteners on the puzzle pieces 840*a-n* secures the puzzle assembly 840.

Figure 10:
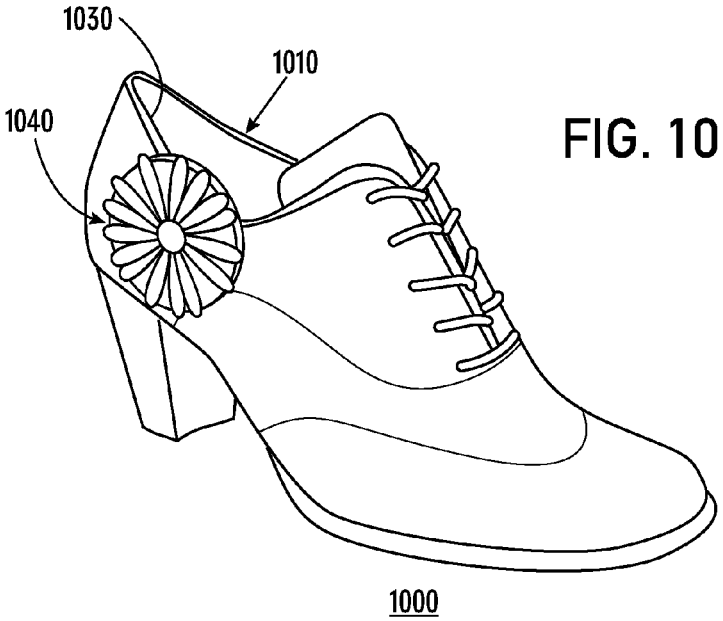
FIG. 10 is a perspective view of an exemplary embodiment of interchangeable decorative ornaments configured to be worn on footwear in accordance with the present invention.

Referring now primarily to FIG. 10, another exemplary embodiment of a wearable assembly in accordance with the present invention is illustrated in a perspective view as a footwear assembly 1000. The footwear assembly 1000 includes a shoe 1010 and a decorative ornament 1040. The decorative ornament 1040 can be similar to the decorative ornament 140. The decorative ornament 1040 can be coupled to a peripheral top edge 1030 of a shoe opening with a clip, similar to the coupling member 168 described with reference to FIG. 4.

Figure 11:
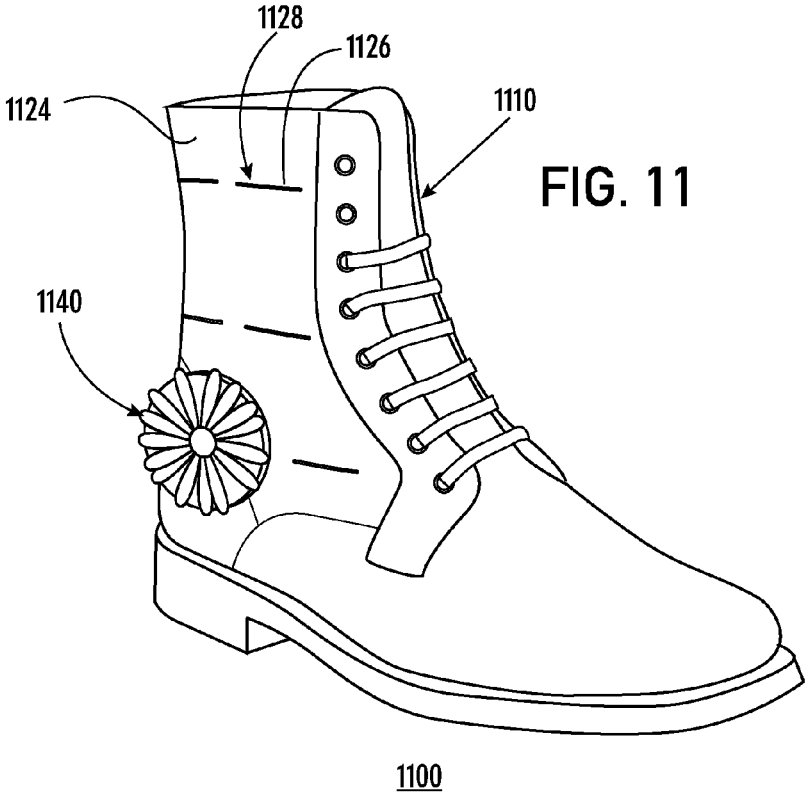
FIG. 11 is a perspective view of another exemplary embodiment of interchangeable decorative ornaments configured to be worn on footwear in accordance with the present invention.

Referring now primarily to FIG. 11, yet another exemplary embodiment of a wearable assembly in accordance with the present invention is illustrated in a perspective view as a footwear assembly 1100. The footwear assembly 1100 includes a boot 1110 and a decorative ornament 1140. The boot 1110 can include a slit 1126 through a surface 1124 of the boot 1110, the slit 1126 defining an opening 1128 sized and configured to receive a coupling member (not shown) of the decorative ornament 1140. The decorative ornament 1140 can be similar to the decorative ornament 140. The decorative ornament 1140 can be coupled to the boot 1110 by the coupling member (not shown), similar to the coupling member 148, that is sized and configured to pass through the opening 1128 of the slit 1126 and rest on the boot 1110 with a curved portion of the hook (not shown).

Figure 12:
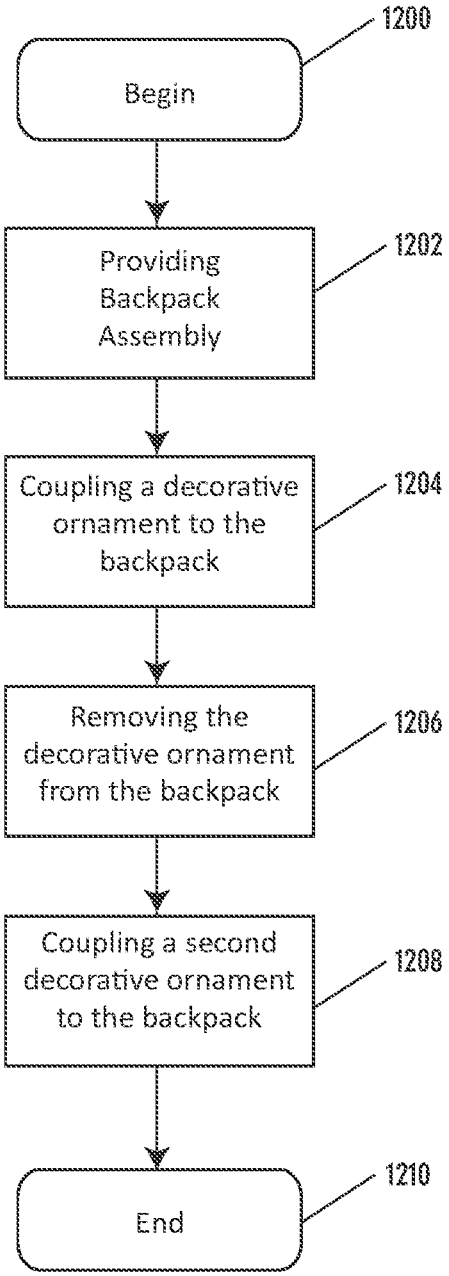
FIG. 12 is a flow diagram for illustrating a process of using the backpack assembly of FIG. 1.

Referring now primarily to FIG. 12, there is provided a method for interchangeably decorating a backpack assembly. The process of FIG. 12 begins at step 1200 and moves directly to step 1202, where the user provides a backpack assembly, such as the backpack assembly 100 of FIG. 1. The backpack assembly 100 includes a plurality of decorative ornaments, where at least one of the plurality of decorative ornaments is different in appearance from a second one of the plurality of decorative ornaments 140. In step 1204, the user couples at least one of the plurality of decorative ornaments 140 to the front panel 114 of the backpack assembly 100. In step 1206, the user removes the decorative ornament from the front panel. In step 1208, after the user removes the decorative ornament 140, the user couples the second one of the plurality of decorative ornaments 140 to the front panel 114 to selectively, interchangeably alter the visual appearance of the backpack assembly 100, without having to purchase a new backpack or permanently alter the backpack main body 110 by, for example, drawing on the backpack main body 110 using permanent marker. The process ends at step 1210.

An assembly has been disclosed that provides selectively removeable and interchangeable decorative features coupled to a display surface of a wearable item, for providing visual variety and entertainment to wearable items, while reducing costs associated with purchasing several wearable items in order to obtain user desired variety.

What is claimed is:

1. A backpack assembly comprising:

a backpack main body:

including a front panel opposite a rear panel and defining a storage compartment; and at least one fastener on at least a portion of the backpack main body;

a first decorative panel:

having a shape corresponding to a shape of the front panel of the backpack main body; and having at least one mating fastener operably configured to mate with the at least one fastener on the backpack main body for selectively, removably coupling the first decorative panel to the backpack main body so as to cover at least a portion of the front panel of the backpack main body;

wherein the at least one fastener on the backpack main body is disposed on a flap coupled to and extending around a peripheral edge of the front panel of the backpack main body such that when the flap is folded downward toward the front panel, the at least one fastener is selectively couplable to the at least one mating fastener on the first decorative panel.

2. The backpack assembly in accordance with claim 1, wherein:

the first decorative panel is made of a material that is configured to receive and display markings from at least one of: ink, crayon, and paint.

3. The backpack assembly in accordance with claim 1, wherein:

the first decorative panel includes a three-dimensional decorative ornament.

4. The backpack assembly in accordance with claim 1, wherein:

the first decorative panel includes a plurality of puzzle pieces that form a unified decorative feature when the plurality of puzzle pieces are assembled together edge-to-edge in an assembled configuration.

5. The backpack assembly in accordance with claim 1, wherein:

the first decorative panel is sized to substantially cover the front panel of the backpack main body when the at least one mating fastener on the first decorative panel is coupled to the at least one fastener on the backpack main body.

6. The backpack assembly in accordance with claim 1, wherein:

the first decorative panel is sized to entirely cover the front panel of the backpack main body when the at least one mating fastener on the first decorative panel is coupled to the at least one fastener on the backpack main body.

7. The backpack assembly in accordance with claim 1, further comprising:

a second decorative panel having a decorative feature different than a decorative feature on the first decorative panel.

8. The backpack assembly in accordance with claim 1, further comprising:

a shoulder strap extending from the backpack main body, the shoulder strap having a shoulder strap front panel and a shoulder strap rear panel, the shoulder strap front and rear panels defining an opening therethrough; and a decorative ornament with a clip adapted to fasten onto the shoulder strap by sliding the clip into the opening.

9. The backpack assembly in accordance with claim 1, wherein:

the first decorative panel includes a plurality of puzzle pieces that form a unified decorative feature when the plurality of puzzle pieces are assembled together edge-to-edge in an assembled configuration; and each of the plurality of puzzle pieces includes at least one arm extending from a side of the puzzle piece, the at least one arm sized and shaped to matingly engage arm-receiving apertures defined by an adjacent one of the plurality of puzzle pieces in the assembled configuration.

10. The backpack assembly in accordance with claim 1, wherein:

the at least one fastener on the backpack main body is disposed on an interior surface of the flap coupled to and extending around a peripheral edge of the front panel of the backpack main body.

11. A backpack assembly comprising:

a backpack main body:

including a front panel opposite a rear panel and defining a storage compartment; and a first zipper half extending continuously about a portion of the front panel of the backpack main body;

a pair of shoulder straps extending from a surface of the rear panel;

a first decorative panel:

having a shape corresponding to a shape of the front panel of the backpack main body; and having a second zipper half extending continuously about a portion of the first decorative panel and configured to mate with the first zipper half for selectively, removably coupling the first decorative panel to the backpack main body so as to cover at least a portion of the front panel of the backpack main body.

12. The backpack assembly in accordance with claim 11, wherein:

the first decorative panel is made of a material that is configured to receive and display markings from at least one of: ink, crayon, and paint.

13. The backpack assembly in accordance with claim 11, wherein:

the first decorative panel includes a three-dimensional decorative ornament.

14. The backpack assembly in accordance with claim 11, wherein:

the first decorative panel includes a plurality of puzzle pieces that form a unified decorative feature when the plurality of puzzle pieces are assembled together edge-to-edge in an assembled configuration.

15. The backpack assembly in accordance with claim 11, further comprising:

at least one of the pair of shoulder straps having a shoulder strap front panel and a shoulder strap rear panel, the shoulder strap front and rear panels defining an opening therethrough that is configured to receive a clip of a decorative ornament.

* * * * *